US009782029B1

(12) United States Patent
FitzSimons

(10) Patent No.: US 9,782,029 B1
(45) Date of Patent: Oct. 10, 2017

(54) LID AND METHOD OF USING A LID

(71) Applicant: Corytus, LLC, Oklahoma City, OK (US)

(72) Inventor: Colin FitzSimons, Oklahoma City, OK (US)

(73) Assignee: CORYTUS, LLC, Oklahoma City, OK (US)

( * ) Notice: Subject to any disclaimer, the term of this patent is extended or adjusted under 35 U.S.C. 154(b) by 0 days.

(21) Appl. No.: 14/264,792

(22) Filed: Apr. 29, 2014

Related U.S. Application Data

(60) Provisional application No. 61/817,761, filed on Apr. 30, 2013.

(51) Int. Cl.

| | |
|---|---|
| ***B65D 51/00*** | (2006.01) |
| ***A47G 19/22*** | (2006.01) |
| ***B65D 51/16*** | (2006.01) |
| ***B65D 45/16*** | (2006.01) |

(52) U.S. Cl.
CPC ..... *A47G 19/2272* (2013.01); *B65D 45/16* (2013.01); *B65D 51/1605* (2013.01)

(58) Field of Classification Search
CPC . A47G 19/2272; B65D 45/16; B65D 51/1605
USPC ..... 220/287, 320; 215/317, 319
See application file for complete search history.

(56) References Cited

U.S. PATENT DOCUMENTS

| | | | | |
|---|---|---|---|---|
| 1,904,091 A * | 4/1933 | Shoop | 220/803 | |
| 3,628,542 A * | 12/1971 | Drew | A24F 5/10 131/176 | |
| 4,747,511 A | 5/1988 | Dutt et al. | | |
| 4,756,440 A | 7/1988 | Gartner | | |
| 4,911,323 A | 3/1990 | Arfert et al. | | |
| 4,961,510 A * | 10/1990 | Dvoracek | 220/713 | |
| 5,749,491 A | 5/1998 | Wylder et al. | | |
| 6,047,852 A | 4/2000 | Evans et al. | | |

(Continued)

FOREIGN PATENT DOCUMENTS

| | | |
|---|---|---|
| GB | 370027 A | 3/1932 |
| GB | 2417952 A | 3/2006 |

(Continued)

OTHER PUBLICATIONS

International Search Report dated Aug. 21, 2014 in PCT/US14/31582, by Applicant Sativa Turner.

*Primary Examiner* — Fenn C Mathew
*Assistant Examiner* — Don M Anderson
(74) *Attorney, Agent, or Firm* — McAfee & Taft, A Professional Corporation

(57) ABSTRACT

The present disclosure relates to a lid and a method of using a lid. The lid includes a body having a top surface, a bottom surface, and a perimeter. The lid also includes a sealing member carried by the perimeter of the body. The sealing member is configured to move between a first position and a second position. The method of using the lid includes the step of positioning the lid with the sealing member in a second position above an open end of a container. The method further includes the step of securing the lid and the container together by moving the sealing member from the second position to a first position to cause engagement of the sealing member with the container thereby forming a removable attachment and a substantial seal between the lid and the container.

23 Claims, 11 Drawing Sheets

(56) References Cited

U.S. PATENT DOCUMENTS

| | | | | |
|---|---|---|---|---|
| 6,164,488 | A | 12/2000 | Solland et al. | |
| 6,276,560 | B1 | 8/2001 | Belcastro | |
| 6,604,645 | B1 | 8/2003 | Vaupotic | |
| 6,883,677 | B2 | 4/2005 | Goeking et al. | |
| 7,185,784 | B2 | 3/2007 | Connors, Jr. et al. | |
| 8,087,539 | B2 | 1/2012 | Auer | |
| 8,091,730 | B2 | 1/2012 | Keefe et al. | |
| 8,286,827 | B2 | 10/2012 | Yacktman | |
| 8,333,299 | B2 | 12/2012 | Kemper et al. | |
| 8,678,212 | B2 * | 3/2014 | Kim | 215/319 |
| 2003/0019876 | A1 | 1/2003 | Burke et al. | |
| 2004/0245258 | A1 | 12/2004 | Connors, Jr. et al. | |
| 2005/0067417 | A1 | 3/2005 | Sanders et al. | |
| 2007/0023434 | A1 * | 2/2007 | Kim | B65D 41/22 220/315 |
| 2008/0061069 | A1 | 3/2008 | Edelstein et al. | |
| 2008/0237247 | A1 | 10/2008 | Mucci et al. | |
| 2009/0272769 | A1 * | 11/2009 | Contreras et al. | 222/420 |
| 2012/0061404 | A1 | 3/2012 | Roth et al. | |
| 2012/0067910 | A1 | 3/2012 | Chun | |
| 2013/0233854 | A1 | 9/2013 | Smyers et al. | |
| 2013/0284753 | A1 | 10/2013 | Kellmann | |

FOREIGN PATENT DOCUMENTS

| | | | |
|---|---|---|---|
| WO | 2014040039 | A1 | 3/2014 |
| WO | 2014160642 | A1 | 10/2014 |

* cited by examiner

FRONT

REAR

SIDE

LID AND METHOD OF USING A LID

CROSS REFERENCE TO RELATED APPLICATIONS

This application claims priority from U.S. Provisional Patent Application Ser. No. 61/817,761 filed Apr. 30, 2013 and entitled A LID AND METHOD OF USING A LID, the entire contents of which are incorporated herein by reference.

BACKGROUND

During an athletic event, for example, a running race, runners are often provided a cup of liquid, usually between about 6.0 to about 9.0 ounces of water or a sports drink, in either a paper or plastic based cup at an aid station. It is difficult for the runner to continue to run and drink this liquid without: spilling; disrupting the runner's pace or breathing; or upsetting the runner's stomach due to swallowing excess air. In longer distance races these issues can contribute to diminished performance. Additionally, the lack of ability to drink while running creates a significant mess around aid stations that affect other runners due to slippery conditions and discarded cups. Because runners' do not typically wish to carry a cup of sloshing liquid, runners try to drink and discard the cups all within approximately thirty (30) yards (27.43 meters) of an aid station. While trash bins are normally located near the aid station, a vast majority of cups are simply thrown on the ground, thus increasing (i) safety concerns for other runners slipping and falling on the discarded cups; and (ii) the need for additional manpower or volunteers to clean up the discarded cups from the ground.

In another situation, for example, on an airplane, passengers are provided a cup of liquid. Many passengers also use his/her portable electronic devices during the flight. When the airplane experiences turbulence, or the cup is simply knocked over, the liquid within the cup may spill onto the vulnerable electronic devices and thereby ruin the electronic devices.

In other situations, young children may be too young or lack the coordination skills to drink from an open container without spilling. Special cups with matching lids are manufactured and sold to address the spilling of cups by children. When the matched lid is misplaced, the cup becomes useless for its spill-proof convenience, and is usually discarded for lack of the matched lid.

Like the mismatched children's cup lid, a similar problem exists with food storage containers. Often the matching lid of a storage container goes missing and thus, the container can no longer be enclosed with a lid. Household bowls and cups do not typically come with matching lids. If a person is desirous of covering the open end of the container, he/she must use a make-shift cover with plastic wrap or aluminum foil. The make-shift cover has limited ability to be reused and is usually discarded into the trash after a few uses. The discarded material contributes to the growing waste in landfills and waters throughout the world. Therefore, it is desirable to have a lid that does not require a matched container that can be used with varying sized cups or containers.

In view of the above identified problems, a need exists for a versatile, portable, reusable, and universal lid to cover a container of varying sizes and shapes, and thereby minimize spilling of the container contents. Further, a need exists for a method providing removable attachment of the universal lid to containers.

SUMMARY

A lid comprising a body having a top surface, a bottom surface, and a perimeter, and a sealing member carried by the perimeter of the body is disclosed. The sealing member is configured to move between a first position and a second position, wherein the first and second positions are different.

A method of removably securing a lid to a container is disclosed. The container includes an open end, and the lid includes a body having a top surface and a bottom surface, and a sealing member extending around a perimeter of the body. The method comprises positioning the lid with the sealing member in a second position above the open end of the container. The sealing member is extending upward from the top surface when the sealing member is in the second position. The method also comprises securing the lid and the container together by moving the sealing member from the second position to a first position to cause engagement of the sealing member with an outer surface of the container thereby forming a removable attachment and a substantial seal between the lid and the container.

DETAILED DESCRIPTION

Figure 1A:
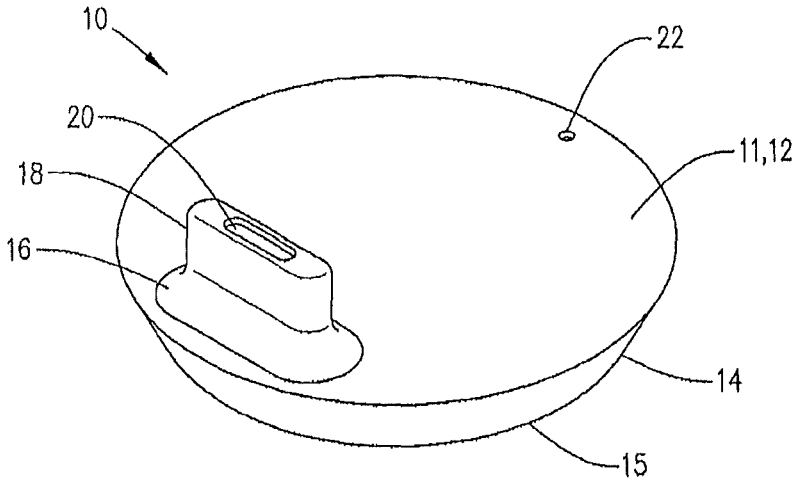
FIG. 1A is a perspective view of the lid with a spout when the sealing member is in a first position.
Figure 1B:
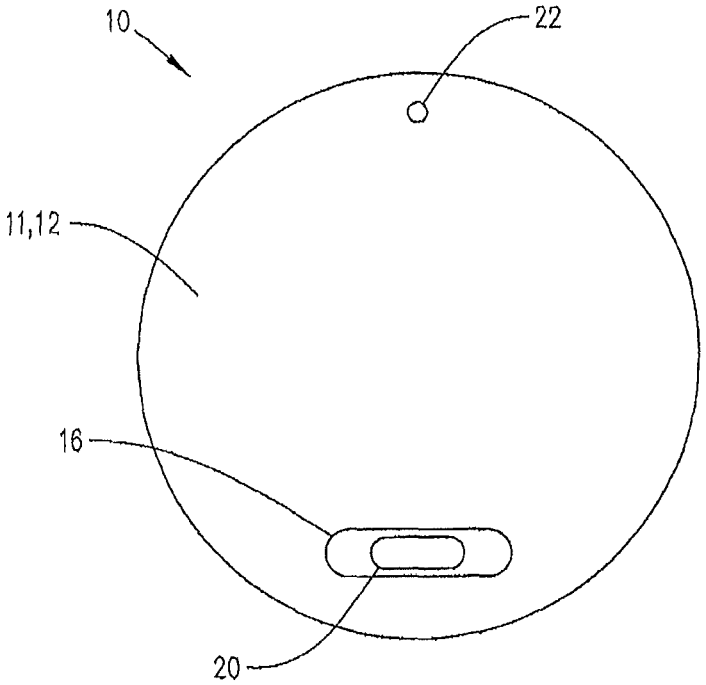
FIG. 1B is a top view of FIG. 1A.
Figure 1C:
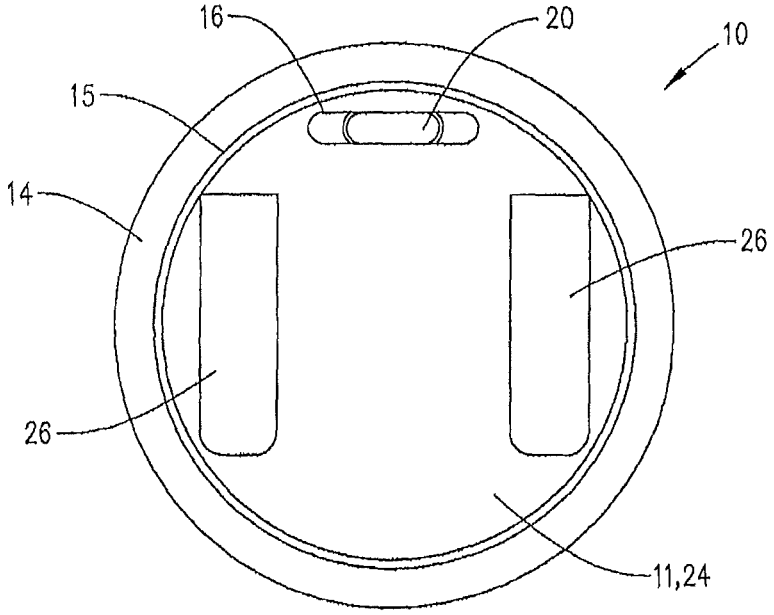
FIG. 1C is a bottom view of FIG. 1A.
Figure 2A:
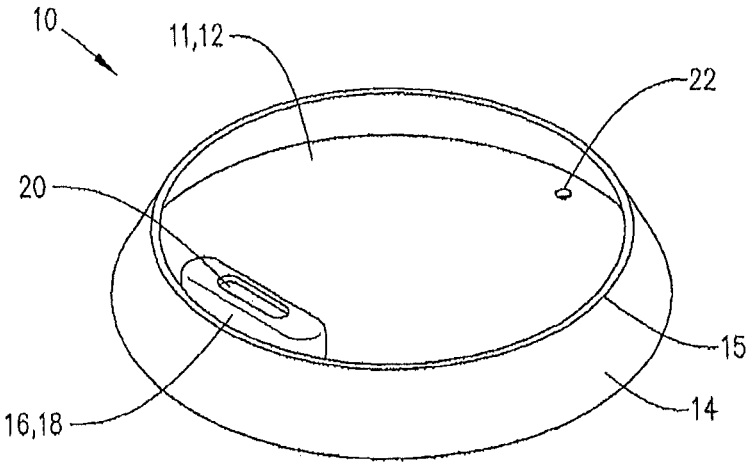
FIG. 2A is a perspective view of the lid with a spout when the sealing member is in a second position.
Figure 2B:
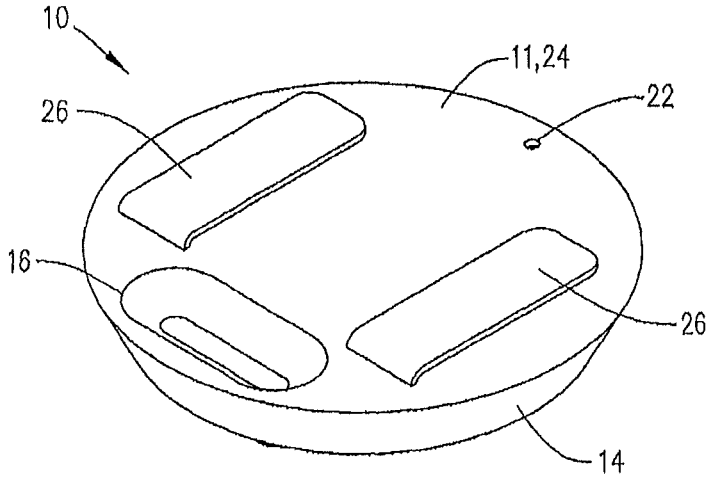
FIG. 2B is a perspective view of the underside of the lid as depicted in FIG. 2A.
Figure 2C:
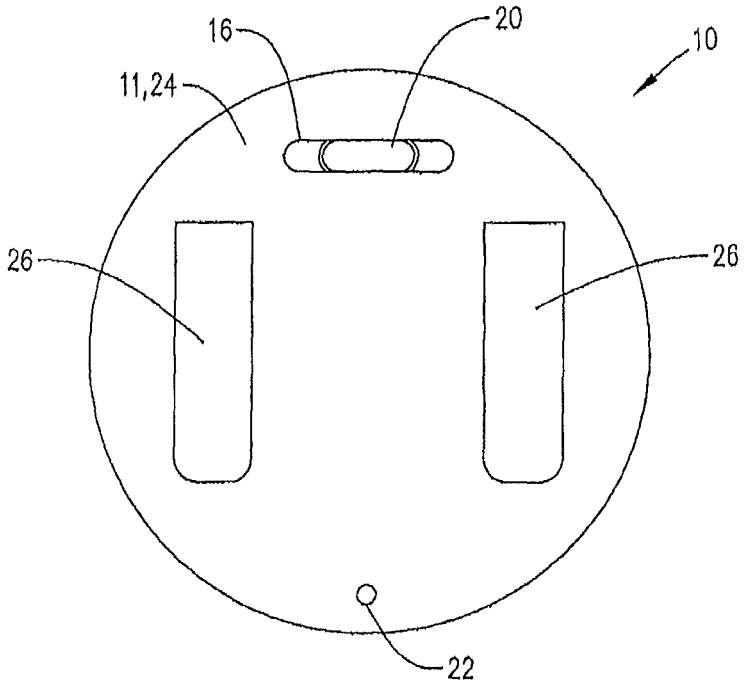
FIG. 2C is a bottom view of FIG. 2A.
Figure 2D:
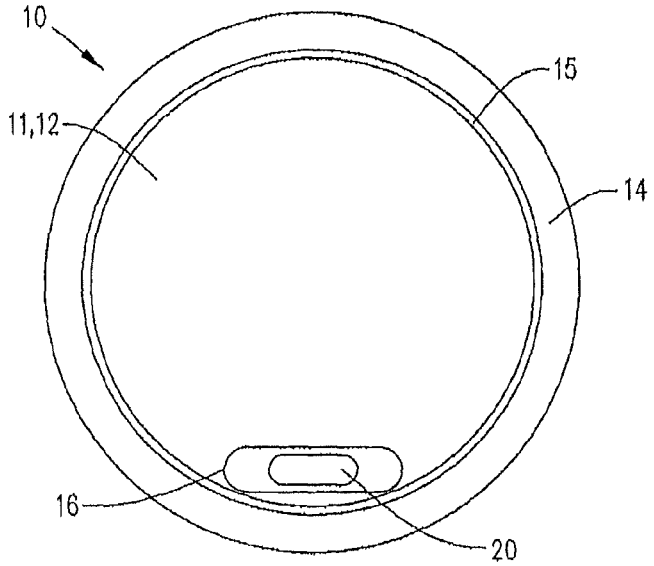
FIG. 2D is a top view of FIG. 2A.

The apparatus and method described herein provide removable attachment of a lid with a container. The apparatus described herein includes a body having a first and second surface and a sealing member carried on the perimeter of the body. The sealing member provides for removable coupling of the lid with a container. The lid may also include a fastening member attached to the second surface of the body. In lieu of, or in addition to the fastening member, the lid may also include a spout extending outward from the first surface. The spout has an opening in the top end thereof.

The spout defines a conduit to permit fluid communication through the body of the lid.

In most applications of the described device, the selected material comprising the lid will be generally safe for use in connection with human consumption and will not be susceptible to erosion or wear due to contact with the contents to be housed within the container or due to environmental exposure. The material comprising the lid is generally made from materials with characteristics similar to an elastomer, i.e. materials, natural or synthetic, that emulate one or more characteristics of rubber, elastomers, rubber-like materials, and elastomeric-like materials. The rubber or elastomeric type materials may be in the form of polymers or copolymers having elastomeric properties or the quality of elasticity. Although not exclusively, such elastomeric materials may be comprised of, include, or be blended with one or more of the following: ethylene-propylene monomer, ethylene-propylene-diene monomer, cis-polyisoprene, cis-polybutadiene, styrene-butadiene rubber, or various plastic polymers including but not limited to polypropylene or polystyrene. Such elastomeric materials may be modified by the covalently linking of multiple elastomers, cross-linking of polymer chains (vulcanization), addition of fillers, or treatment with chemicals. Suitable materials comprising the lid exhibit tensile strengths at break when measured at 73° F. (degrees Fahrenheit) in the range of about 250 psi (pounds per square inch) to about 550 psi; material tensile elongation when measured at 73° F. in the range of about 340% to about 800%; and, Shore A hardness values between about 27 to about 55.

Referring to the FIGS., lid 10 includes a body 11 having a top surface 12 and a bottom surface 24. Top surface 12 and bottom surface 24 are also referred to as first surface and second surface, respectively. First surface 12 and second surface 24 are generally planar.

As shown in the FIGS., lid 10 further includes sealing member 14. Sealing member 14 is carried by the perimeter of body 11. For example, during the manufacturing process of lid 10, sealing member 14 may be integrally joined with body 11. Sealing member 14 is configured to flip about the perimeter of body 11 between a first position and a second position. The first position of sealing member 14 is depicted in FIGS. 1A-1C, 3A, 3B, 4D, 6D, 7A-7C, 8A, and 8B. As shown in the FIGS., when sealing member 14 is in the first position, sealing member 14 projects downward and away from first surface 12 toward second surface 24. For configurations of lid 10 that include spout 16, first position may also be referred to as the drinking position.

The second position of sealing member is depicted in FIGS. 2A-2D, 3C, 4A, 5A-5C, 6A, and 8C. In the second position, sealing member 14 projects outward and away from second surface 24. As can be seen in FIGS. 1A, 2A 8A, and 8C, sealing member 14 flips about the perimeter of body 11 such that sealing member 14 in the second position is a mirror image of the first position with body 11 serving as the axis, plane or flex point about which sealing member 14 is flipped.

Regardless of whether sealing member is in the first or second positions, sealing member 14 may taper inward toward the center of body 11. Thus, the circumference of edge 15 may be less than the circumference of body 11. Sealing member 14 is made of one or more resilient, flexible materials which enable sealing member 14 to flip between the first and second positions, and enable the removable coupling of lid 10 to container 30. Further, by providing a configuration where edge 15 defines a circumference less than body 11, sealing member 14 provides an enhanced seal against container 30. Suitable materials for sealing member 14 may be made of one or more elastomeric type materials selected from the group consisting of elastomers, thermoplastic elastomers (TPE), thermoplastic vulcanizates (TPV), rubber, polypropylene, polychloroprene, silicone, plastic, and combinations thereof. Such elastomeric materials may be modified by the covalently linking of multiple elastomers, cross-linking of polymer chains (vulcanization), addition of fillers, or treatment with chemicals. In most applications of the present device, the suitable materials will typically be safe for use in association with human consumption per standards set by appropriate governmental authorities, e.g. the United States Pharmacopeial Convention (USP) Class VI, Food Drug Administration (FDA) by and through Title 21 CFR (Code of Federal Regulations) parts 170-199, and National Sanitation Foundation (NSF)/American National Standards Institute (ANSI) Standard 61 (NSF-61), NSF-51, combinations thereof, and similar family of standards, certifications, regulations, variations thereto, and successors thereof.

Suitable elastomeric type materials for use as sealing member 14 exhibit tensile strengths at break when measured at 73° F. in the range of about 250 psi to about 550 psi; material tensile elongation when measured at 73° F. in the range of about 340% to about 800%; and, Shore A hardness values between about 27 to about 55.

As shown in FIGS., movement of sealing member 14 from the first position to the second position permits removable coupling of lid 10 to container 30 when sealing member 14 is in a first position. As depicted in 4D, sealing member 14 is configured to move between the first position and the second position, thereby providing a removable coupling between lid 10 and container 30 by engaging the outer surface of container 30.

As depicted in FIGS. 4A-4D, body 11 completely covers opening 32 of container 30 and rests on top of rim 34. As shown, sealing member 14 extends down the outer surface of container 30. Some container rims may include lips or flanges extending from the rim, whereas other containers may not. Regardless of the whether the container rim includes any projections, sealing member 14 provides removable securement of lid 10 to container 30.

Sealing member 14 engages the outer surface of container 30 by extending substantially around the outer perimeter of container 30. As a result of the elastomeric nature of sealing member 14, positioning of sealing member 14 in the first position results in engagement of sealing member 14 against the outer surface or perimeter of container 30 with sufficient pressure to form a releasable seal. The releasable seal is sufficient to prevent fluid loss while permitting ready removal of lid 10 from container 30. In particular, when edge 15 defines a circumference less than the circumference of body 11, the reduction in circumference enhances the pressure applied by sealing member 14 to the outer surface of container 30 to ensure a removable, yet fluid tight seal. Thus, sealing member 14 removably joins lid 10 and container 30 by conforming to the exterior surface of container 30 to create a substantial seal around the exterior perimeter of container 30.

To removably secure lid 10 to container 30, sealing member 14, in the first position, extends down the outer surface of container 30 from the top of rim 34 to a distance sufficient to removably couple lid 10 and container 30 together. The distance sufficient to removably couple lid 10 and container 30 together will vary depending on the sizes of lid 10 and container 30.

Due to a wide variety of container 30 sizes and opening 32 sizes, body 11, in combination with sealing member 14, may entirely cover opening 32, or body 11 may only cover a majority of opening 32 of container 30. For example, where body 11 only covers a majority of opening 32 of container 30 sealing member 14 provides the remainder of the covering over opening 32. In addition, where sealing member 14 provides the remainder of the covering over opening 32, sealing member 14 further extends over rim 34 to provide a releasable seal sufficient to retain the contents of container 30 within container 30 thereby releasably securing lid 10 to container 30.

As depicted in the FIGS., lid 10, including body 11, are depicted as generally circular in shape. It should be appreciated that lid 10, including body 11, may take the form of various geometric shapes, for example, a square, rectangle, triangle, pentagon, ellipse, etc. The shape of lid 10, including body 11 and sealing member 14, can be the same shape of opening 32 or container 30, or can be a different shape.

Body 11 may be any size or shape suitable to cover opening 32 of container 30 and removably secure lid 10 to container 30. Typically, the dimensions of body 11 may range from about 1.25 inches (3.175 centimeters) to about 28 inches (71.12 centimeters) and all values therebetween, in diameter. Lid 10 may be made of an elastomeric material or materials with characteristics similar to an elastomer, including, but not limited to, a substantially fluid impermeable elastomeric type materials. Lid 10 and body 11 may be made of one or more elastomeric type materials selected from the group consisting of elastomers, thermoplastic elastomers (TPE), thermoplastic vulcanizates (TPV), rubber, polypropylene, polychloroprene, silicone, plastic, and combinations thereof. Such elastomeric materials may be modified by the covalently linking of multiple elastomers, cross-linking of polymer chains (vulcanization), addition of fillers, or treatment with chemicals. In most applications of the present device, the suitable materials will typically be safe for use in association with human consumption per standards set by appropriate governmental authorities, e.g. the United States Pharmacopeial Convention (USP) Class VI, Food Drug Administration (FDA) by and through Title 21 CFR (Code of Federal Regulations) parts 170-199, and National Sanitation Foundation (NSF)/American National Standards Institute (ANSI) Standard 61 (NSF-61), NSF-51, combinations thereof, and similar family of standards, certifications, regulations, variations thereto, and successors thereof.

Sealing member 14 may range in length from about 0.20 inches (5.08 millimeters) to about 5.0 inches (12.7 centimeters), and all values therebetween. The ratio of the length of sealing member 14 to the diameter of body 11 may range from about 1:3 to about 1:25, and all values therebetween.

The hardness of the materials comprising lid 10 may be adjusted during the manufacturing process depending upon end-use applications. For example, when sealing member 14 is approximately 15.0 millimeters (mm) in length and body 11 is approximately 74 millimeters in diameter (a ratio of about 1:4.93), the hardness of body 11 may be approximately 70±40 Durometer of Shore Type A and the hardness of sealing member 14 may be approximately 40±15 Durometer of Shore Type A. As the sizes of body 11 and sealing member 14 increase, the hardness of the materials may also increase to an extent depending on the end use of lid 10. Similarly, as the sizes of body 11 and sealing member 14 decrease, the hardness may decrease to an extent depending on the end use of lid 10. For example, if the end use of lid 10 will be for covering containers that can be stacked, the body 11 may need to be harder than sealing member 14. Suitable elastomeric type materials for use as body 11 exhibit tensile strengths at break when measured at 73° F. in the range of about 250 psi to about 550 psi; material tensile elongation when measured at 73° F. in the range of about 340% to about 800%; and, Shore A hardness values between about 27 to about 55. Accordingly, it should be appreciated that the hardness of every component of lid 10 may be of the same or different hardness values.

All components of lid 10 may be made of a material suitable to be used in association with human consumption and to withstand varying temperatures, e.g. hot or cold, of the contents within container 30 as well as from the environment in which lid 10 is positioned. It should be appreciated that all components of lid 10 may be made of the same or different materials and formulations.

Lid 10 may also include fastening member 26. Fastening member 26 may be carried by second surface 24 of body 11. When sealing member 14 is in the second position, fastening member 26 provides removable coupling of lid 10 to an item of clothing or other object.

Fastening member 26 is positioned on body 11 to generally avoid contact with and not interfere with or otherwise obstruct sealing member 14. For configurations of lid 10 that include fastening member 26, fastening member 26 may be integrally joined with body 11 during the manufacturing process of lid 10. Additionally, fastening member 26 may be separately bonded or otherwise joined with body 11 after the manufacture of lid 10. Although depicted as located on the bottom or second surface 24 of body 11, fastening member 26 may also be positioned on the top or first surface 12 of body 11.

Fastening member 26 may be made of or coated with one or more materials safe for use in association with human consumption and, in most applications of the described device, will not be susceptible to erosion or wear due to contact with the contents to be housed within the container or due to environmental exposure. For example, such material or coating may include one or more material or coating selected from the group consisting of elastomers, thermoplastic elastomers (TPE), thermoplastic vulcanizates (TPV), rubber, polypropylene, polychloroprene, silicone, plastic, and combinations thereof. Such elastomeric materials may be modified by the covalently linking of multiple elastomers, cross-linking of polymer chains (vulcanization), addition of fillers, or treatment with chemicals. Such materials or coatings may include materials classified under USP Class VI, FDA via CFR 21 parts 170-199, NSF-61, NSF-51, combinations thereof, and similar family of standards, certifications, regulations, variations thereto, and successors thereof as determined by the appropriate governmental agencies discussed above.

Figure 5A:
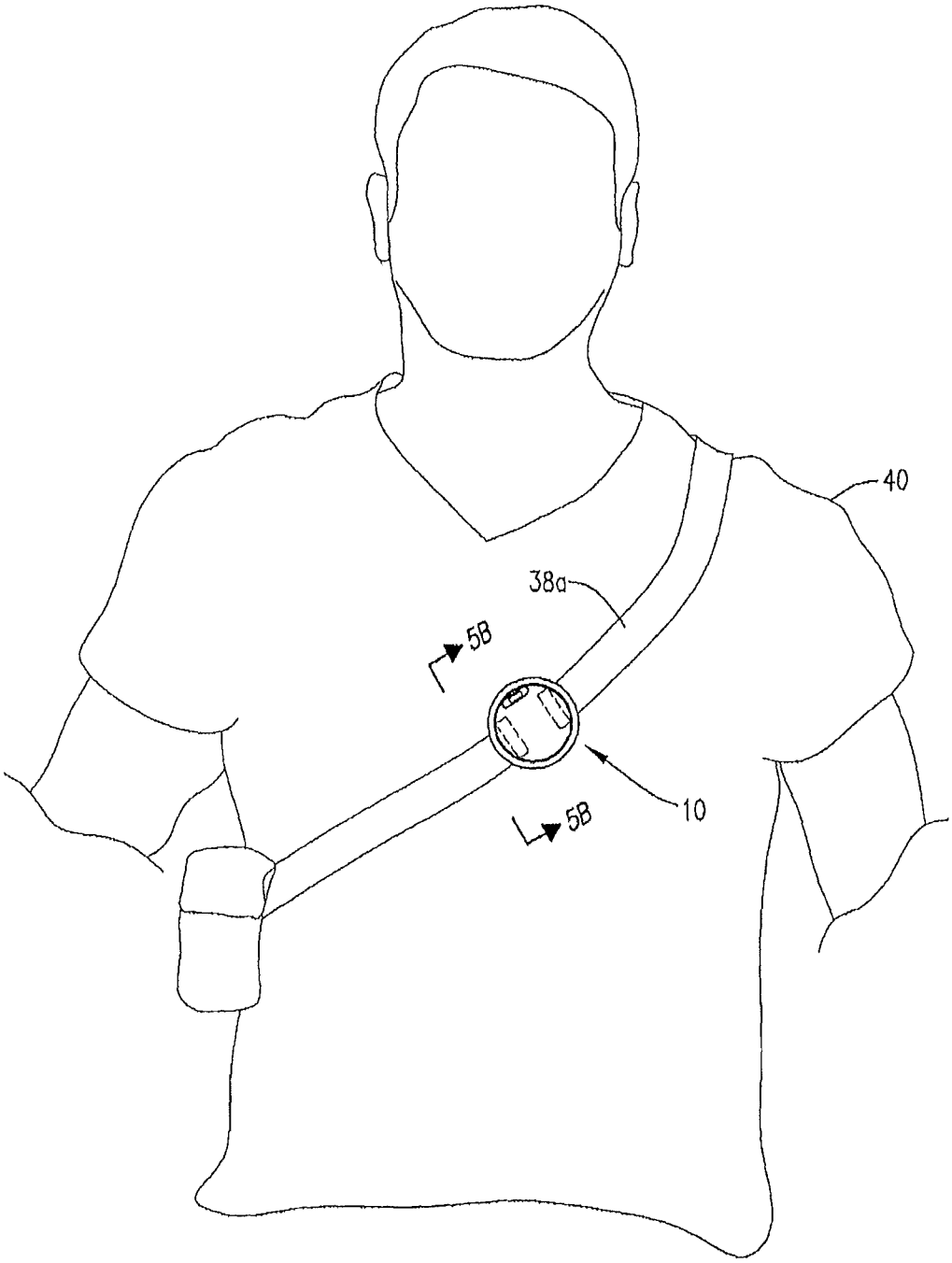
FIGS. 5A-5C depict various views of the lid removably secured to an object when the sealing member is in a second position.
Figure 5B:
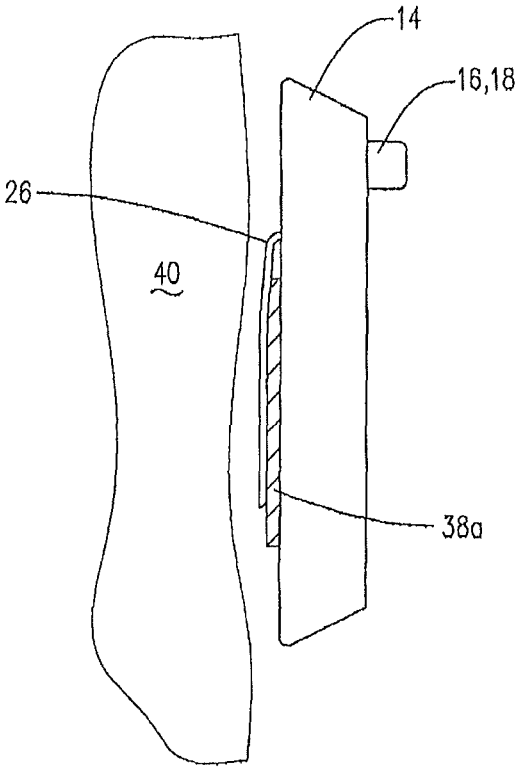
Figure 5C:
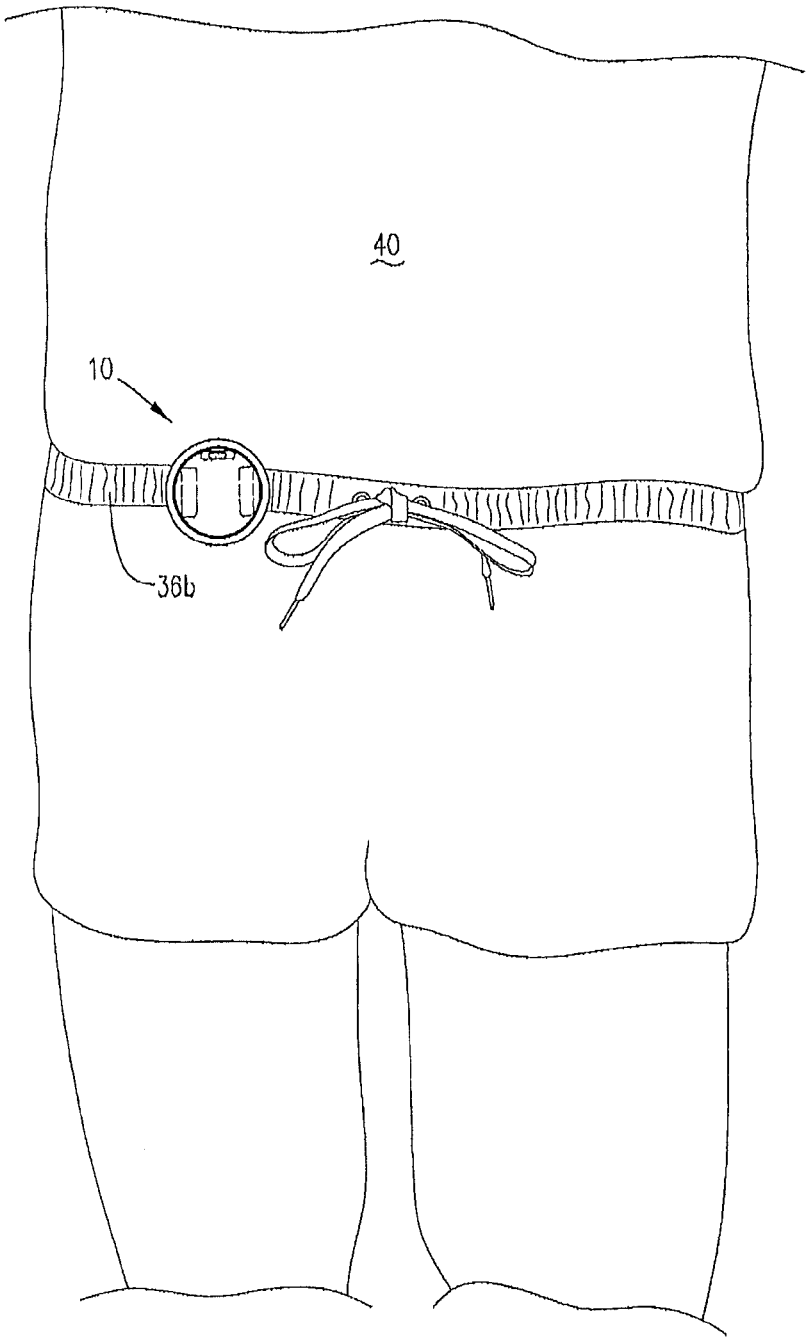

For example, in configurations including fastening member 26, positioning of sealing member 14 in the second position will expose fastening member 26 such that sealing member 14 does not interfere or otherwise obstruct the ability of fastening member 26 to removably couple lid 10 to an object other than a container 30 as illustrated in FIGS. 5A-5C.

In the FIGS., fastening member 26 is depicted as a clip. As shown in FIGS. 1C, 2B, 2C, and 5A-5C, there are two fastening members 26. Thus, the depicted device includes configurations having one or more fastening members 26. Additionally, the placement of fastening member 26 on body 11 may vary depending on the type of fastening member used, the size of body 11, and/or the size of fastening member 26. Any location of fastening member 26 on body 11 is suitable such that fastening member 26 does not interfere with the described features and functions of the other components described herein.

Figure 3A:
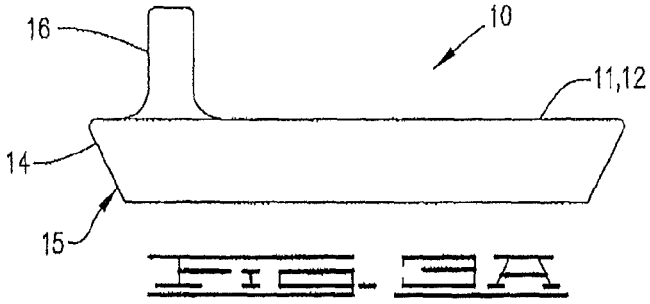
FIG. 3A is a side view of FIG. 1A.
Figure 3B:
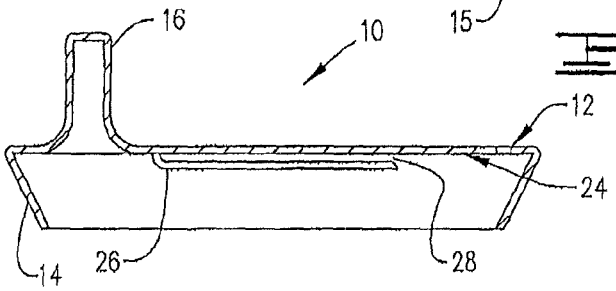
FIG. 3B is a cross sectional view of FIG. 3A.
Figure 3C:
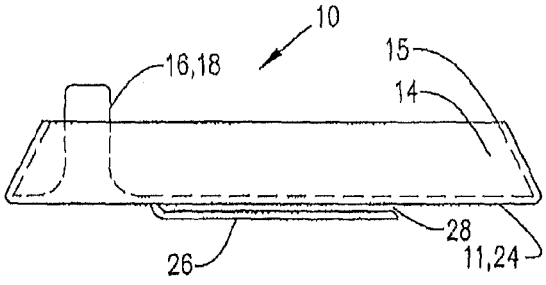
FIG. 3C is a side view of FIG. 2A.

For example, when fastening member is a clip, as depicted in the FIGS., clip 26 has sufficient resiliency to permit deflection of clip 26 away from body 11 thereby enabling temporary coupling of lid 10 to an object by placement of the object between clip 26 and body 11. In particular, the degree of resilience should permit sliding of lid 10 along the coupling point. For example, as shown in FIG. 5A, lid 10 is slideably positioned on strap 38*a* of a bag carried by person 40. As shown in FIGS. 3B and 3C, fastening member 26 is carried by body 11. Fastening member 26 and second surface 24 of body 11 define a space 28 therebetween. FIG. 5B depicts that part of the object, e.g. strap 38*a*, to which fastening member 26 is slideably positioned on is received in space 28. FIG. 5C depicts lid 10, with sealing member 14 in the second position and encircling spout 16, secured to the waistband or belt 38*b* of person 40 by slideably positioning fastening member 26 thereon. Thus, when lid 10 is carried by fastening member 26 on a belt or strap, sealing member 14 also partially shields spout 16 from foreign material.

For configurations of lid 10 where fastening member 26 is a clip, fastening member 26 and object 38 are removably coupled and may generally be held together by friction. In the clip embodiment of fastening member 26, the connection mechanism and forces experienced are similar to, for example, a paper clip holding papers together, or a bobby pin holding hair, or a vehicular visor clip, such as a garage door opener on a visor. It should be appreciated as the size of lid 10 varies, the size of fastening member 26 may also vary such that the size of fastening member 26 does not obstruct or prohibit the ability of lid 10 to removably attach to a container whilst sealing member 14 is in a first position. In addition, fastening member 26 will be of a size suitable to enable removable attachment of lid 10 to an object 38 when sealing member 14 is in a second position.

Fastening member 26 may be any fastener suitable for achieving the above-described functions. For example, fastening member 26 may include, for example, snap fasteners, hooks, buttons, magnetic fastening mechanisms, screwing mechanisms, retaining pins, clasps, spring-type clothespin, or combinations thereof. Fastening member 26 may be integrally coupled to second surface 24 such that fastening member 26 and second surface 24 are flush with one another. It should be appreciated that for whatever fastening mechanism used for fastening member 26, that object 38 will have the appropriate mating mechanism, if necessary, known in the art to couple with fastener member 26.

Lid 10 may also include spout 16 extending outward from first surface 12. Spout 16 includes top end 18 and an opening 20 in top end 18. Spout 16 defines an opening in body 11 and permits fluid communication through body 11. In other embodiments of spout 16, not depicted, spout 16 may include a plurality of openings as opposed to the one opening 20 depicted in top end 18.

As shown in FIGS. 2A, 2D, 4A, 5A-5C, spout 16 is positioned on body 11 to generally avoid contact and not interfere with sealing member 14 when sealing member 14 is in the second position. Spout 16 is shaped and sized to be received by a human mouth. Spout 16 is made of one or more materials safe for use in association with human consumption. For example, spout 16 may be made of one or more material selected from the group consisting of elastomers, thermoplastic elastomers (TPE), thermoplastic vulcanizates (TPV), rubber, polypropylene, polychloroprene, silicone, plastic, and combinations thereof. Such elastomeric materials may be modified by the covalently linking of multiple elastomers, cross-linking of polymer chains (vulcanization), addition of fillers, or treatment with chemicals. In most applications of the present device, the suitable materials will typically be safe for use in association with human consumption per standards set by appropriate governmental authorities, e.g. the USP Class VI, FDA by and through Title 21 CFR parts 170-199, and NSF-61, NSF-51, combinations thereof, and similar family of standards, certifications, regulations, variations thereto, and successors thereof. For lid 10 configurations that incorporate spout 16, spout 16 may be integrally joined with body 11 during the manufacturing process of lid 10.

For lid 10 configurations that include spout 16, lid 10 may optionally include one or more vent holes 22 between first surface 12 and second surface 24 of body 11. Vent hole 22 provides an air vent and permits fluid, e.g. air, to pass through body 11 in order to prevent a vacuum effect when lid 10 is removably coupled with container 30.

Figure 4A:
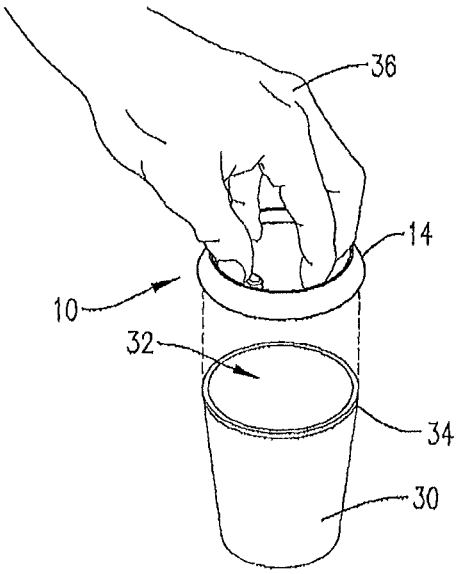
FIGS. 4A-4D are exemplary illustrations of using the lid.
Figure 6A:
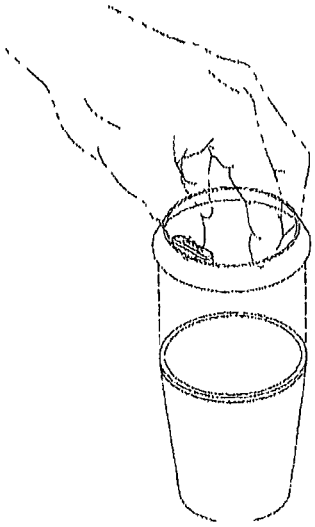
FIGS. 6A-6D illustrate the placing and positioning of the lid on a container.
Figure 6B:
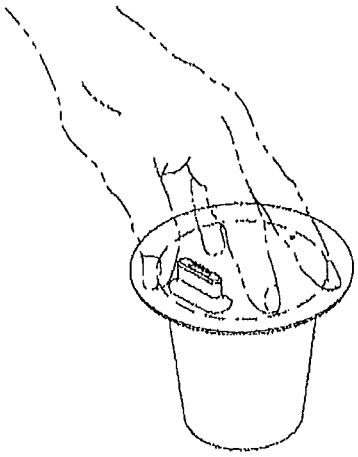
Figure 6C:
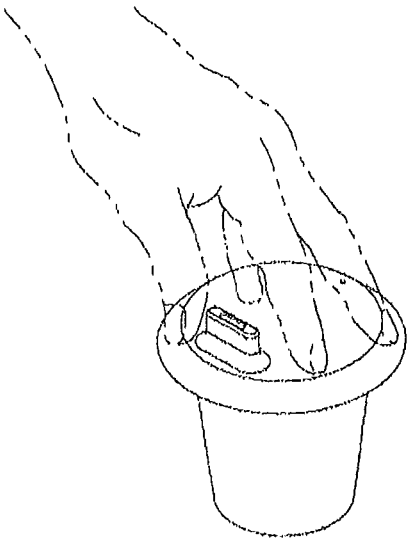
Figure 6D:
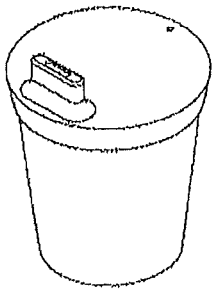
Figure 7A:
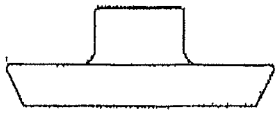
FIGS. 7A-7C depict various views of the lid.
Figure 7B:
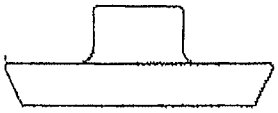
Figure 7C:
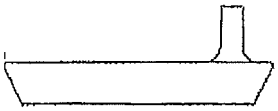
Figure 8A:
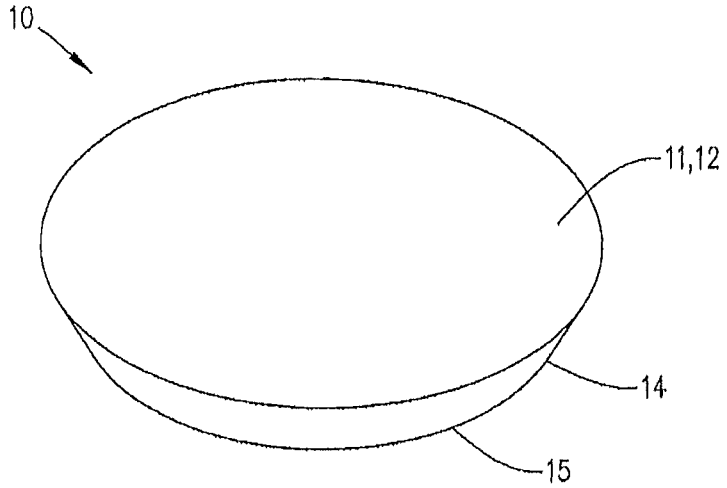
FIG. 8A is a perspective view of the lid without a spout when the sealing member is in a first position.
Figure 8B:
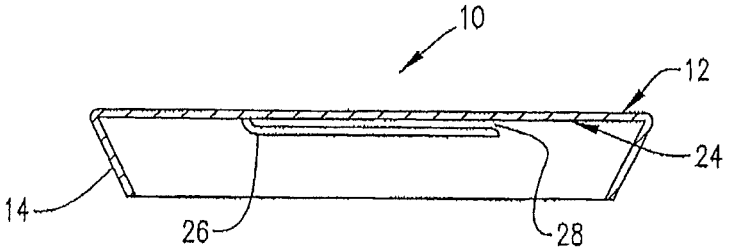
FIG. 8B is a cross-sectional view of the lid depicted in FIG. 8A.
Figure 8C:
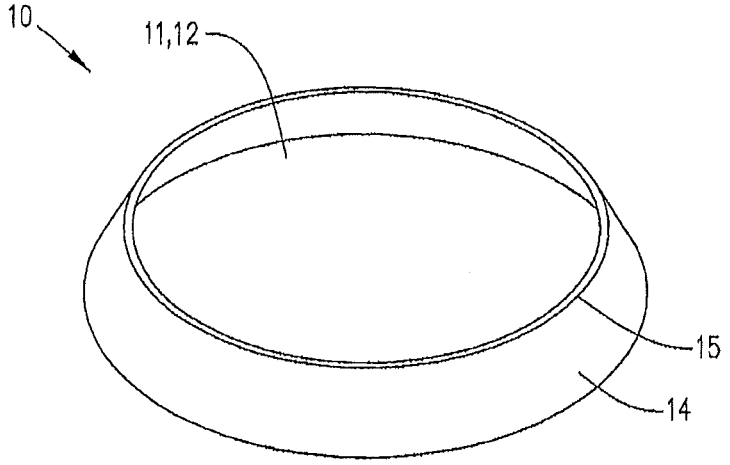
FIG. 8C is a perspective view of the lid of FIG. 8A when the sealing member is in a second position.

FIGS. 4A-4D and 6A-6D depict a method of removably securing lid 10 to container 30. As shown in the FIGS. container 30 includes an open end 32 defined by rim 34. Container 30 defines a cavity for receiving a fluid or other contents therein. As shown in FIGS. 4A and 6A, body 11 is of a size that completely covers open end 32 and is supported by rim 34. The method of removably securing lid 10 to container 30 includes positioning lid 10 with sealing member 14 in a second position above the open end 32 of container. As shown in FIG. 4A, sealing member 14 extends upward from top surface 12 when sealing member 14 is in the second position. As depicted in FIG. 4A, the user may place his/her hand 36 within the area defined by the edge 15 of sealing member 14 with his/her fingers in close proximity to each other. When lid 10 is placed on container 30, rim 34 supports lid 10.

The method further includes securing lid 10 and container 30 together by moving sealing member 14 from the second position to a first position to cause engagement of sealing member 14 with container 30 thereby forming a removable attachment and substantial seal between lid 10 and container 30.

Figure 4B:
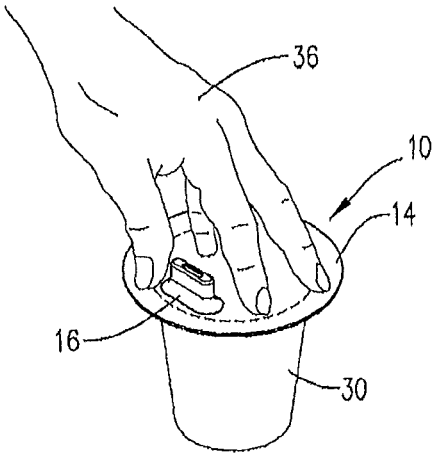

FIG. 4B illustrates the user flaring his/her fingers of hand 36 outward from the center of his/her palm to cause sealing member 14 to move from the second position to the first position. Any movement of hand 36, use of more than one hand by one or more individuals, or mechanism of causing sealing member 14 to move from the second position to the first position in order to removably couple lid 10 and container 30 are also suitable.

Figure 4C:
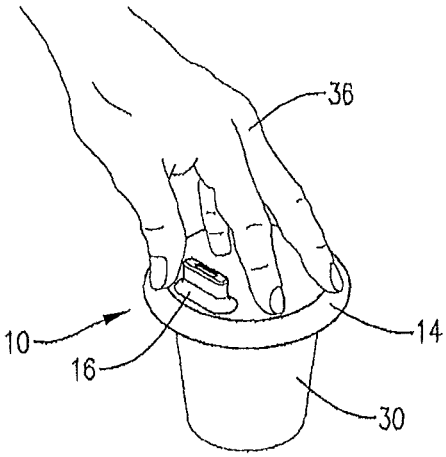
Figure 4D:
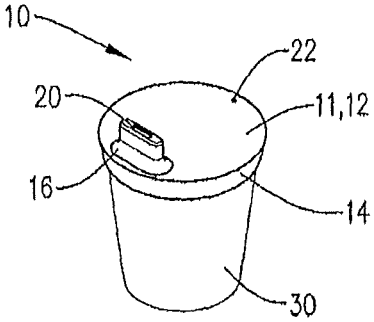

FIG. 4C illustrates the continued movement of sealing member 14 from the second position to the first position prior to engaging container 30. FIG. 4D illustrates the sealing member 14 engaged with container 30 when sealing member is in the first position. As was previously discussed, sealing member 14 conforms to the exterior perimeter of container 30 and secures the removable coupling of lid 10 and container 30. As a result of this coupling, a substantial seal between lid 10 and container 30 is created. The substantial seal prevents liquid within container 30 from spilling out of open end 32. For example, where lid 10 includes spout 16 and/or vent hole 22, liquid may pass through either opening or both.

After the securing step is complete, the method may further include disengaging of lid 10 from container 30 by causing sealing member 14 to partially move away from container 30 so that lid 10 and container 30 may be moved apart from each other. The disengaging step may also be accomplished by moving sealing member 14 from the first position to the second position.

Other embodiments of the apparatus and method will be apparent to one skilled in the art. As such, the foregoing description merely enables and describes the general uses and methods of the described device. Accordingly, the following claims define the true scope of the present device.

What is claimed is:

1. A lid comprising:

a planar body having a top surface, a bottom surface, and a perimeter, wherein said perimeter is defined by the body between said top surface and said bottom surface;

an annular sealing member directly joined with said perimeter of said body as a single piece and said annular sealing member extending radially outward from said perimeter of the body, wherein the annular sealing member is configured to move about the perimeter of the body between a first position and a second position, wherein said first and second positions are different, wherein when the sealing member is in the first position the annular sealing member projects downward and away from the top surface, and wherein when the annular sealing member is in the second position the annular sealing member projects outward and away from the bottom surface, and wherein when the annular sealing member is at a position halfway between the first position and the second position, the annular sealing member is planar with and concentric with the body; and a spout extending outward from the top surface, wherein the spout includes a top end and an opening in the top end, and wherein the spout defines an opening in the body to provide fluid communication through the body.

2. The lid of claim 1 further comprising:

a fastening member carried by the bottom surface.

3. The lid of claim 1, wherein movement of the sealing member from the first position to the second position permits removable coupling between the lid and a container.

4. The lid of claim 2, wherein the fastening member is configured to provide removable coupling of the lid when the sealing member is in a second position.

5. The lid of claim 1, wherein the body is configured to substantially cover an open end of a container when the lid is removably coupled to the open end of the container.

6. The lid claim 1, wherein the lid is made of one or more materials selected from the group consisting of elastomers, thermoplastic elastomers, thermoplastic vulcanizates, rubber, polypropylene, polychloroprene, silicone, plastic, and combinations thereof.

7. The lid of claim 1 further comprising:

a vent hole providing fluid communication through said body.

8. The lid of claim 1, wherein a ratio of the length of sealing member to the diameter of the body ranges from about 1:3 to about 1:25.

9. The lid of claim 1, wherein the sealing member has an edge which tapers inward toward the center of the body.

10. The lid of claim 1, wherein the lid is made of one or more material that exhibit a tensile strength at break of about 250 pounds per square inch to about 550 pounds per square inch when measured at 73 degrees Fahrenheit, a material tensile elongation in the range of about 340% to about 800% when measured 73 degrees Fahrenheit, and a Shore A hardness value between about 27 to about 55.

11. A flexible lid comprising:

a planar body having a first surface, a second surface, and a perimeter defined by the body between the first and second surfaces;

an annular sealing member;

an integral flex point located between said planar body and said annular sealing member and securing said annular sealing member to said perimeter of said planar body as a single piece such that said annular sealing member may flip from an upwardly projecting position extending above said body to a downwardly projecting position extending below said body, and when said annular sealing member is at a position halfway between said upwardly projecting position and said downwardly projecting position said annular sealing member is planar with and concentric with said body and said integral flex point;

wherein the annular sealing member has an edge which tapers inward toward the center of the body, and wherein when the annular sealing member is in the upwardly projecting position the edge of the annular sealing member projects upward and away from the second surface, and wherein when the annular sealing member is in the downwardly projecting position, the annular sealing member removably attaches the lid to a container;

a fastening member carried by the second surface; and a spout extending outward from the first surface, wherein the spout includes a top end and an opening in the top end, and wherein the spout defines a conduit to permit fluid communication through the body.

12. The lid of claim 11, wherein the lid is made of one or more material that exhibit a tensile strength at break of about 250 pounds per square inch to about 550 pounds per square inch when measured at 73 degrees Fahrenheit, a material tensile elongation in the range of about 340% to about 800% when measured 73 degrees Fahrenheit, and a Shore A hardness value between about 27 to about 55.

13. The lid of claim 11, wherein the sealing member is configured to removably attach the lid and container together by engaging an outer surface of the container.

14. The lid of claim 11, wherein a ratio of the length of sealing member to the diameter of the body ranges from about 1:3 to about 1:25.

15. The lid of claim 11, wherein the fastening member is a clip.

16. The lid of claim 11, wherein the lid is made of one or more materials selected from the group consisting of elastomers, thermoplastic elastomers, thermoplastic vulcanizates, rubber, polypropylene, polychloroprene, silicone, plastic, and combinations thereof.

17. The lid of claim 11 further comprising:

a hole between the top and bottom surface to allow fluid to pass through said body.

18. A method of removably securing a lid to a container, the container including an open end, and the lid including a planar body having a top surface, a bottom surface, and a perimeter defined by the body between the top surface and the bottom surface, and an annular sealing member directly joined with said body as a single piece, said annular sealing member extending radially around the perimeter of the body and said annular sealing member configured to flip about the perimeter of the body, and wherein the lid further includes a spout extending outward from the top surface, wherein the spout includes a top end and an opening in the top end, and wherein the spout defines a conduit to permit fluid communication through the body, the method comprising:

positioning the lid with the annular sealing member in a second upwardly projecting position extending above the top surface above the open end of the container;

securing the lid and the container together by moving the annular sealing member from the second upwardly extending position to a first downwardly projecting position by causing the annular sealing member to flip about the perimeter of the body to cause engagement of the annular sealing member with an outer surface of the container thereby forming a removable attachment and a substantial seal between the lid and the container, wherein the annular sealing member extends downward from the top surface when the annular sealing member is in the first downwardly projecting position, and wherein when said annular sealing member is at a position halfway between said second upwardly projecting position and said first downwardly projecting position said annular sealing member is planar with and concentric with said body; and wherein the lid further includes a spout extending outward from the top surface, wherein the spout includes a tope end and an opening in the top end, and wherein the spout defines a conduit to permit fluid communication through the body.

19. The method of claim 18, further comprising the step of:

disengaging the lid from the container by causing the sing ng member to move away from the container, wherein the disengaging step is done after the securing step.

20. The method of claim 19, wherein the disengaging step causes the sealing member to move from the first position to the second position.

21. A flexible lid comprising:

a planar body having a first surface, a second surface, and a perimeter defined by the body between the top and bottom surfaces;

a fastening member carried by the second surface;

a sealing member extending radially from and integrally joined with said perimeter of the body, said sealing member and said body are a single piece; and a spout extending outward from the first surface, wherein the spout includes a top end and an opening in the top end, and wherein the spout defines a conduit to permit fluid communication through the body, wherein the sealing member is configured to move about the perimeter of the body between a first position and a second position, wherein when the sealing member is in the first position, the sealing member is configured to provide a removable coupling between the lid and a container, wherein the sealing member has an edge distal from said integrally joined union of said sealing member and said perimeter, the edge tapers inward toward the center of the body, wherein when the sealing member is in the first position the edge of the sealing member projects downward and away from the first surface, and wherein when the sealing member is in the second position the edge of the sealing member projects outward and away from the second surface, wherein when the sealing member is in a position halfway between the first position and the second position the sealing member is planar with and concentric with the body, and wherein a ratio of the length of sealing member to the diameter of the body ranges from about 1:3 to about 1:25.

22. The method of claim 18, wherein when securing the lid and the container together the sealing member does not engage the interior of the container.

23. A lid comprising:

a planar body having a top surface, a bottom surface, and a perimeter defined by the body between the top and bottom surfaces;

a sealing member extending around said perimeter and directly joined to said perimeter of the body and forming a single piece therewith, wherein the sealing member is configured to move about said perimeter of the body between a first position and a second position, wherein said first and second positions are different, wherein when the sealing member is in the first position the sealing member projects downward and away from the top surface, wherein when the sealing member is in the second position the sealing member projects upward and away from the bottom surface, wherein when the sealing member is in a position halfway between the first position and the second position the sealing member is planar with and concentric with the body, and wherein movement of the sealing member from the first position to the second position permits removable coupling between the lid and a container; and a spout extending outward from the top surface, wherein the spout includes a top end and an opening in the top end, and wherein the spout defines an opening in the body to provide fluid communication through the body.

* * * * *